United States Patent [19]

Harvey

[11] 4,274,218

[45] Jun. 23, 1981

[54] DISPLAY DEVICES

[75] Inventor: Brian F. Harvey, Liverpool, England

[73] Assignee: Colin Robert Alty, Lancashire, England

[21] Appl. No.: 68,105

[22] Filed: Aug. 20, 1979

[51] Int. Cl.[3] ..... G09F 11/06
[52] U.S. Cl. ..... 40/505
[58] Field of Search ..... 40/505, 503, 504, 473

[56] References Cited

U.S. PATENT DOCUMENTS

| | | | |
|---|---|---|---|
| 1,699,857 | 1/1929 | Ruegger | 40/505 X |
| 1,785,204 | 12/1930 | Nelson et al. | 40/505 |
| 2,978,821 | 4/1961 | Kaufmann | 40/505 |
| 3,657,833 | 4/1972 | Vetter | 40/504 X |
| 4,168,587 | 9/1979 | Falk | 40/505 X |

FOREIGN PATENT DOCUMENTS

| | | | |
|---|---|---|---|
| 433182 | 10/1911 | France | 40/505 |
| 564473 | 10/1923 | France | 40/505 |

*Primary Examiner*—John F. Pitrelli
*Attorney, Agent, or Firm*—Wenderoth, Lind & Ponack

[57] ABSTRACT

A display device comprises a rotary carrier and a plurality of supports for respective display slats which supports are mounted on the carrier for rotation around the axis of rotation of the carrier and for rotation about respective axes, which are equiangularly spaced about the axis of rotation of the carrier. A slat is mounted on each support with its longitudinal center line coaxial with the axis of rotation of the support. The arrangement permits each slat to be turned to show both its faces and by movement of the slats around the axis of the carrier it permits alternative slats to be brought into the display surface.

4 Claims, 19 Drawing Figures

DISPLAY DEVICES

Figure 1:
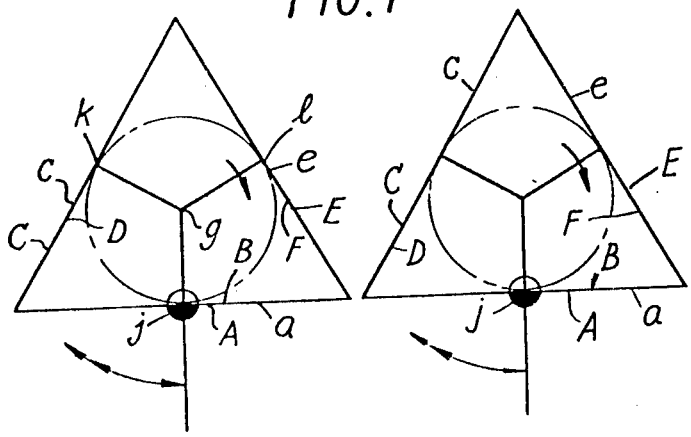
Figure 2:
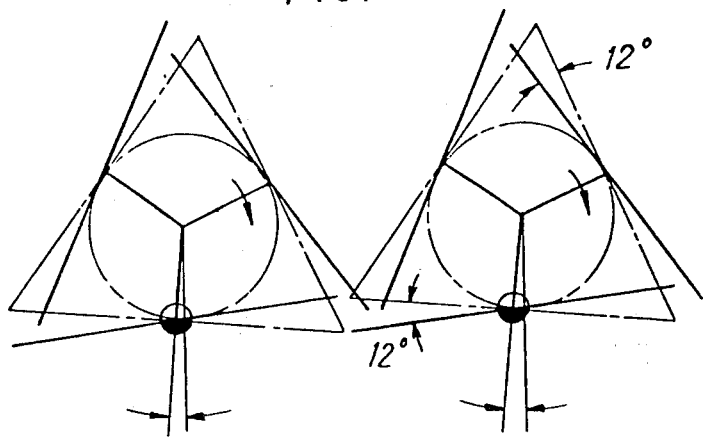
Figure 3:
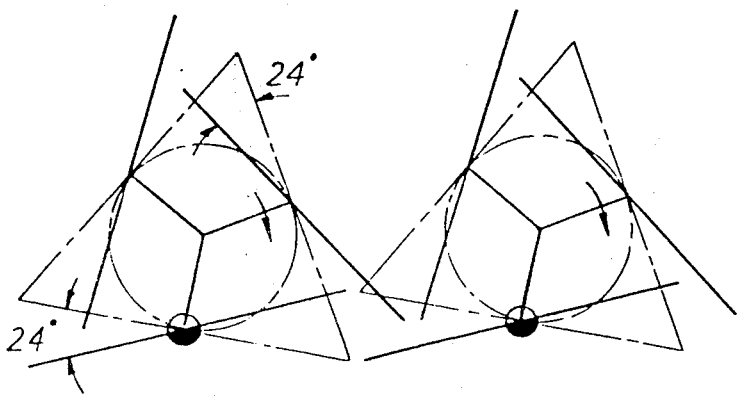
Figure 4:
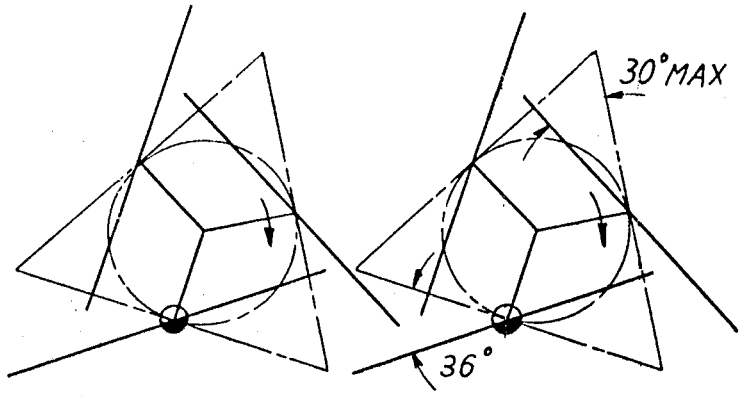
Figure 5:
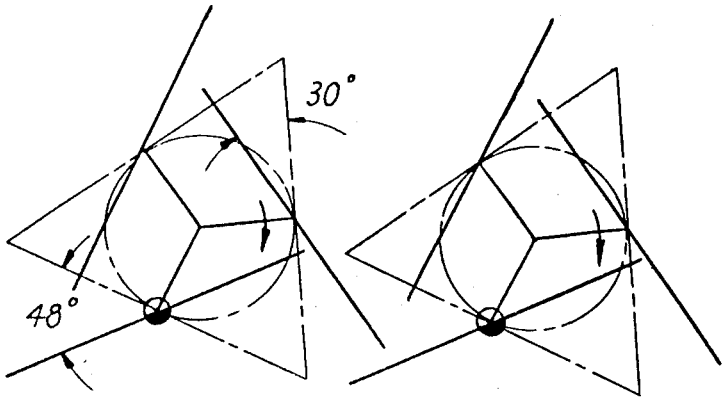
Figure 6:
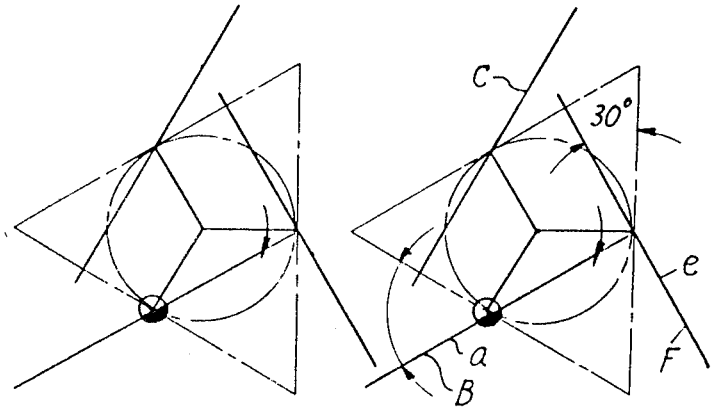
Figure 7:
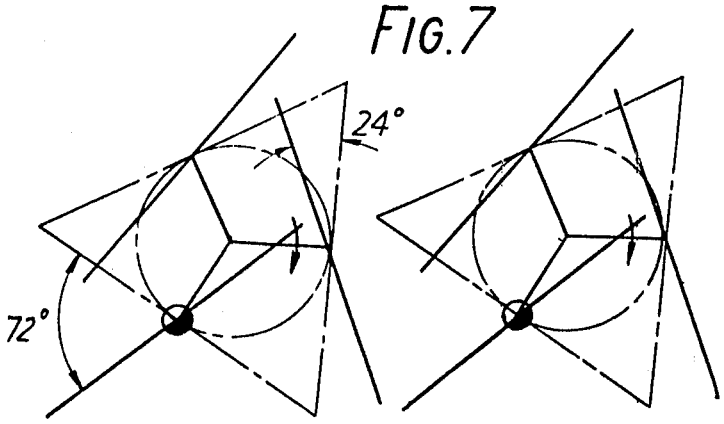

The present invention relates to display devices and in particular to display devices of the type in which a display surface is formed of a series of separate narrow rectangular surfaces arranged in substantially abutting relation along their longitudinal edges, such separate narrow rectangular surfaces being movable into and out of a position in which they form part of the display surface.

One well known form of device of this class comprises a series of members of triangular cross section, mounted side-by-side, each being rotatable about its longitudinal axis and arranged to move through angular steps of 120°, so that each face is cyclically brought into a display surface position in which it is aligned with the corresponding faces of the other triangular members, which are all then halted in such position for a short interval, during which a message or advertisement, covering the whole display surface, is presented for observation.

In another device of the same general type the display surface is composed of separate slat-like elements, each of which forms one of a series carried on spaced drive chains. The number of different messages or advertisements which can be presented is equal to the number of slats in each series.

In both types of device the members forming the interchangeable display are housed, together with their drives, in an enclosed cabinet.

Both forms of device have certain drawbacks. One of the requirements of successful display devices is that there must be initial movement to attract the eye to the device before the display of the message or advertisement commences.

The type of device, having rotatable triangular members, is open to the objection that it can only carry three messages or advertisements. It is also open to the objection that in moving from one display position to the next, the movement is not very conspicuous. The alternative device, in which the slats are carried on chains, is more satisfactory in both these respects, but the construction is expensive by reason of the large number of device chains and furthermore the spatial requirements, particularly depth from front to rear, of its cabinet restrict the use of the device to sites where there is adequate depth available.

It is an object of the invention to enable an improved form of device of this general class to be made which is constructed so as to provide at least four, ad preferably six, alternative display surfaces, but which may be constructed so as to occupy less depth than the type of device in which the individual slats are carried on chains.

According to the present invention there is provided a display device comprising a plurality of rotary carriers mounted for rotation about respective axes which are parallel to each other, each of said carriers having mounted thereon, for rotation about respective second axes which are parallel to and equiangularly spaced about the said axis of rotation of the carrier, a plurality of supports each carrying an elongate display slat whose lengthwise axis is substantially coincident with the said second axis of rotation of the support, and the arrangement of the carriers and supports being such that each slat on each carrier is capable of forming with one slat on each of the other carriers a substantially continuous display surface. This arrangement permits each slat to be turned to show both its faces and by movement of the slats around the axis of the carrier it permits alternative slats to be brought into the display surface. It will be understood that two slats per carrier gives four alternative display surfaces and that three slats per carrier gives six alternative display surfaces. The slats are conveniently mounted for rotation about their center line and their rotation is preferably effected during the course of movement out of the display surface position, since the combined rotational and translational movement of the slat has a much greater effect in catching the eye than a translational movement alone.

In one arrangement made in accordance with the invention the device is provided with a series of rotatable carriers, which are mounted on parallel vertical shafts, the spacing between the shafts being equal to the modular or nominal width of the slats, each carrier carrying three slats which are mounted for rotation about their longitudinal center lines, the axes of the slat pivots being arranged symmetrically about the axis of the carrier at the apices of an equilateral triangle, the sides of which are half the modular width of the slats.

Means are provided for rotating the carriers by 120° steps, with a display period, during which the slats are at rest, in the interval between successive angular movements. In the course of each angular movement of the carrier, that slat which is moving away from the display position is rotated through 180° about its own axis so that the reverse face of the slat is presented when the slat next arrives at the display position. This rotation of the front slat provides a desirable eye-catching movement and is necessarily accompanied by movement of the two other slats mounted on the same carrier as will be explained below. In this arrangement the nominal or modular width of the slats slightly exceeds their actual width by a distance of about 3/32 inch, but the resultant spacing of the slats in the display position is not found deleterious in practice. It is found necessary to provide a spacing of this order to avoid jamming of the slats. It will be appreciated that when one slat of each set is in the display position, the other slats carried by the same carrier are arranged as the sides of an equilateral triangle in relation to it.

In another layout the slats are mounted in a triangular arrangement in a similar way, except that the supports are mounted for guided movement radially away from the axis of the carrier so as to permit one of the slats to be rotated without movement of the other two slats or, in some layouts, with a lesser movement of the other two slats.

Figure 19:
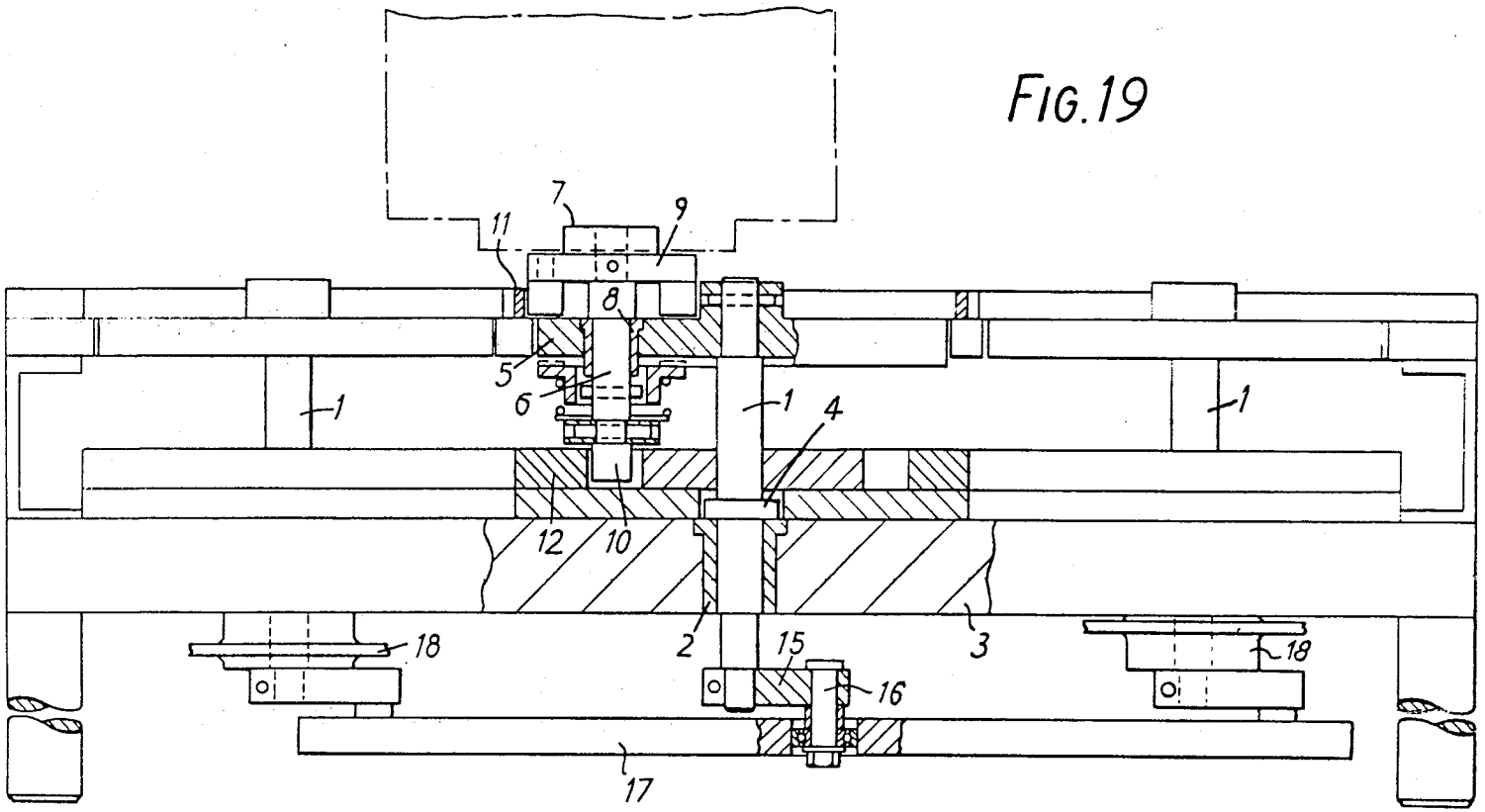

Referring now to the accompanying drawings:

FIGS. 1 to 18 illustrate diagrammatically the series of movements involved in moving the slats of one form of apparatus made in accordance with the invention, and FIG. 19 illustrates a device for driving the arrangement of slats shown in FIGS. 1 to 18.

In FIG. 1 the display surface of the device is composed of the aligned faces A of slats a, only two of which are shown in the series of FIGS. 1 to 18. A set of slats a, c and e are mounted on a carrier. The slats a, c, e respectively have display faces A, B; C,D and E, F. The set of slats a, c, e are mounted on a carrier which is mounted for rotation about axis g. The carrier is rotated about axis g in steps of 120° and many known forms of drive may be employed for that purpose. The slats a, c, e are pivotally mounted in the carrier on axes j, k, l and drive means are provided for turning the slats about these axes to impart the angular motions indicated in FIGS. 1 to 18. One drive means suitable for this purpose is shown in FIG. 19 and will be described presently. The light and dark semi-circles indicated on slats a are shown only to facilitate identification of the two faces of these slats during their rotation as shown in FIGS. 1 to 18.

In FIGS. 1 to 18 the movement of the slats a, c, e during a 120° step of the carrier is illustrated. As will be seen, the carrier is turning clockwise and during the first 90° of movement of the carrier the slat a turns through 180° in relation to slats c and e, so that face B is brought into an outwardly facing position.

From FIGS. 1 to 6 it will be seen that during the first 30° movement of the carrier in clockwise direction, slat a turns through 60° about its axis in anticlockwise direction and during the same interval slats c and e turn through 30° in anticlockwise direction. At this point, shown in FIG. 6, slat a is perpendicular to slat e. In order to avoid a clash between slat a and slat e, it is necessary to reverse the rotation of slat e about its axis l and while the carrier advances from 30° to 48° slats c and e rotate clockwise through 30° to return them to their original angular disposition to each other, i.e. to the relative position shown in FIG. 1. It now becomes necessary to turn slat c clockwise through 30° to allow slat a to reach the position shown in FIG. 11, when it passes the axis k of slat c, in which position slat a is perpendicular to slat c. To avoid clashing between slats c and e, slat e is also rotated clockwise through 30° during the same interval.

During the advance of the carrier from 60° (FIG. 11) to 90° (FIG. 16) slat a performs a final 60° counterclockwise rotation and slats c and e rotate 30° counterclockwise to bring all three slats back to their original relative positions, except that face B now faces outwardly. During the final movement of the carrier from 90° to 120°, the slats a, c and e are at rest in relation to their own axes.

At the end of the 120° movement of the carrier, the faces E are all aligned at the display surface and the carrier is halted during a predetermined display interval.

It will readily be appreciated that all six slat surfaces are brought cyclically into the display position.

Figure 16:
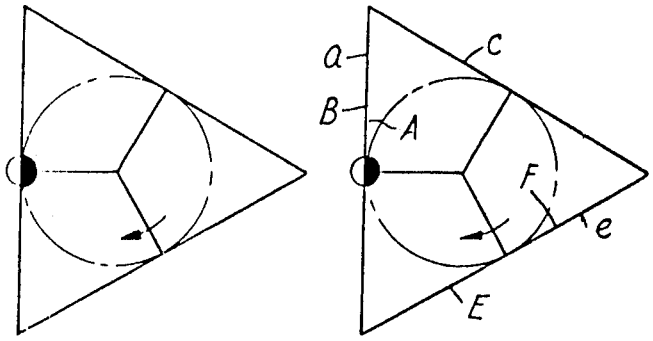
Figure 17:
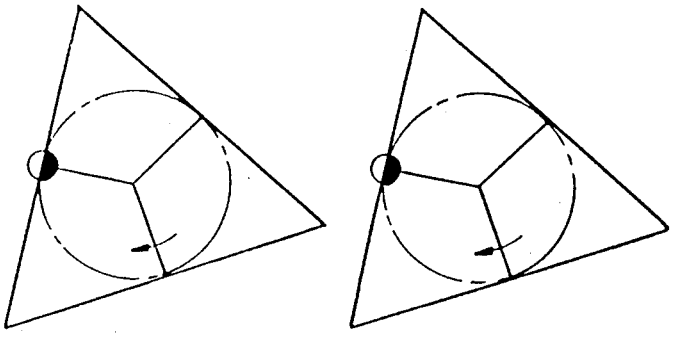
Figure 18:
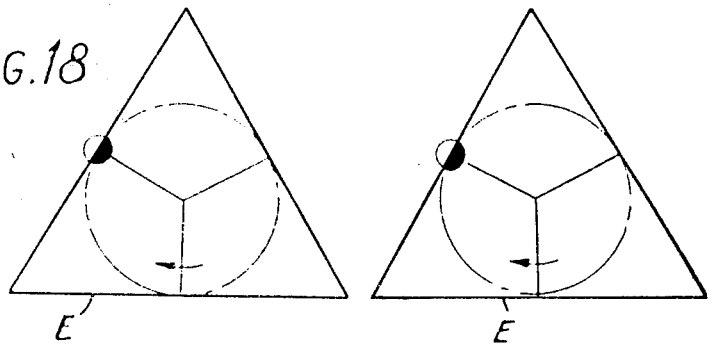

Study of FIGS. 1 to 16 will show that the left hand edge tip of slat a is virtually stationary during movement between the positions shown in FIG. 1 and FIG. 16 and this gives a visual impression that slat a is pivoting about this edge, in a manner similar to the page of a book.

Figure 8:
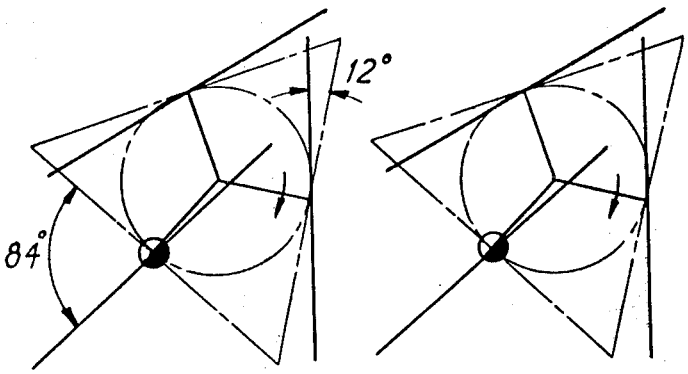
Figure 9:
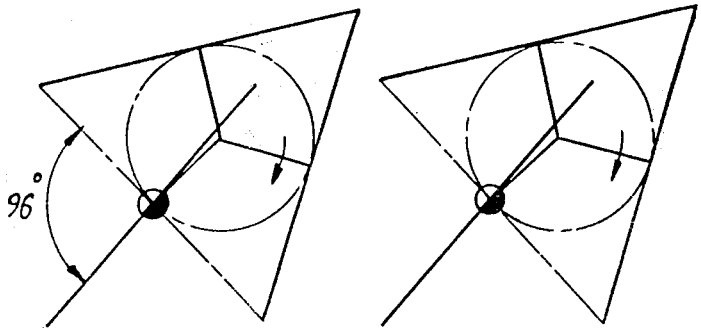
Figure 10:
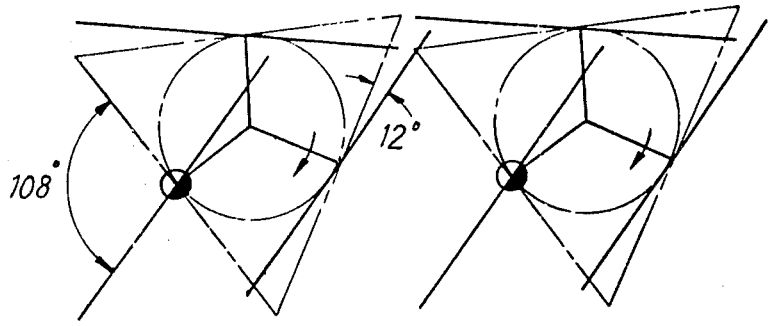
Figure 11:
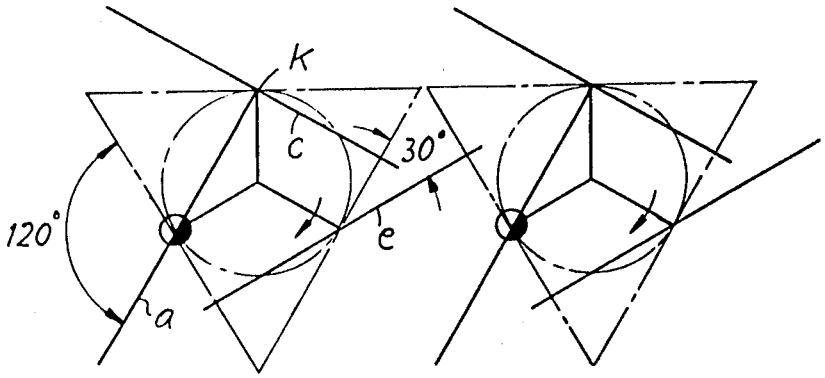
Figure 12:
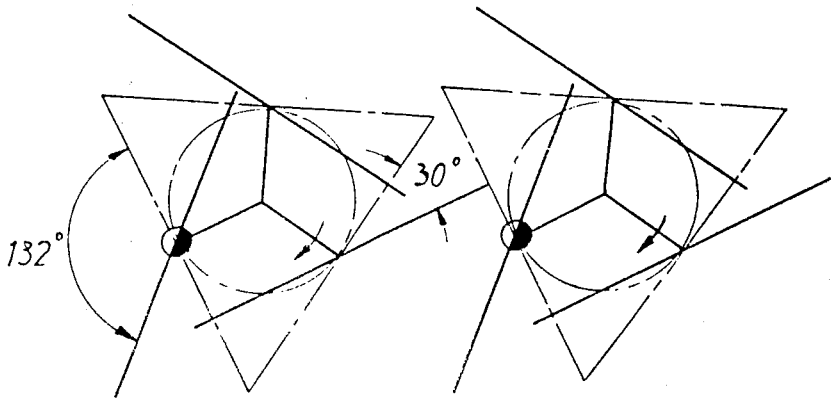
Figure 13:
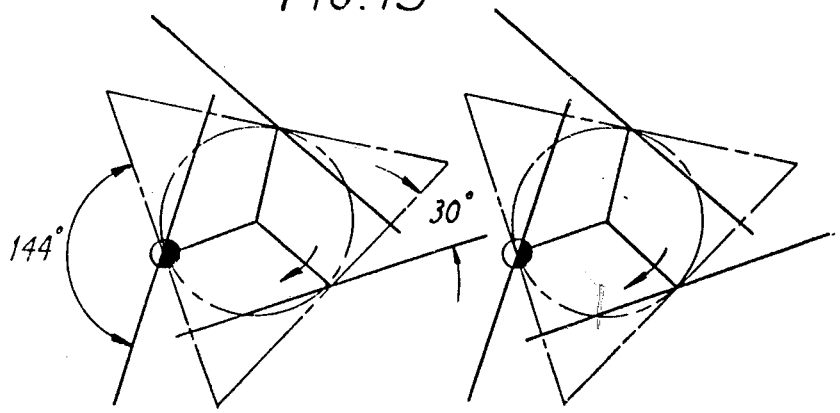
Figure 14:
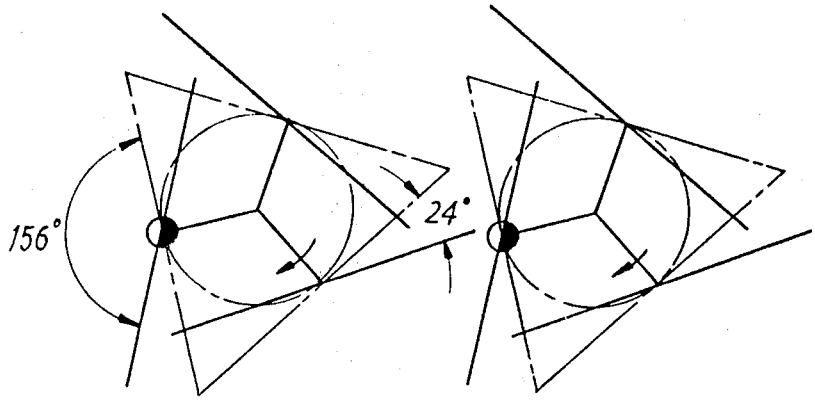
Figure 15:
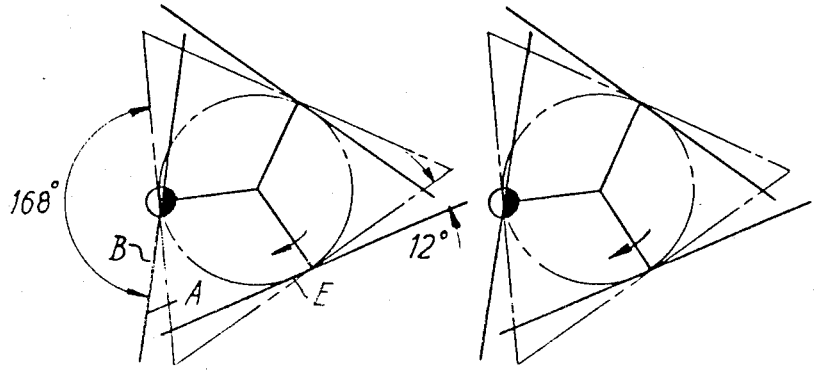

It will be seen that during initial movement of the carrier, progressively larger areas of face F are exposed to view, but that situation reverses suddenly between FIGS. 8 and 10. Thereafter progressively larger areas of face E can be seen.

It will be understood that slats a, c, e need not be elements of the device in its form as sold and each slat need be no more than 2 strips of paper, back to back, held in top and bottom clamps constituting supports, to which the above described motions are imparted, In FIG. 19 there is illustrated a device for driving the slats a, c, e, which are not necessarily integers of the advertising device and may be no more than strips of paper or paper board cut out from an illustration, as explained above. In FIG. 19 the driver for three slat stations only are illustrated, but any number of such stations can be similarly arranged between the two end stations.

At each slat station a drive spindle 1 is rotatably mounted in bearings 2, carried in a frame member 3. The spindle 1 has a collar 4 to prevent downward movement. A slat spindle carrier 5 is secured to the top end of each drive spindle 1 and carries three slat spindles 6 arranged therein at 120° angles. Each spindle 6 is provided with a slat support 7 at its top end and the spindles 6 are turned in their bearings 8 by engagement of upper and lower cam followers 9 and 10, which are arranged at 180° to each other and secured to the related spindle 6. The cam followers 9 engage with an upper cam 1 and the cam follower 10 engages with lower cam 12. The spindles 6 are oscillated as a result of the engagement of their cam followers with the cams 11 and 12 during rotation of the spindle 1. The cams 11 and 12 are developed to oscillate the slats in accordance with FIGS. 1 to 18.

All the spindles 1 carry a crank arm 15, provided with a crank pin 16 rotatably engaged with a connecting rod 17. Thus, in a device having more than three stations, the drive spindles 1 of the additional station will be similarly spaced along and coupled to a connecting rod of appropriate length. The two end spindles 1 carry sprockets 18, which are interconnected by a drive chain (not shown), so that all spindles 1 are turned in synchronism.

The illustrated drive arrangement is duplicated at the top of the cabinet (but inverted) to provide an upper end drive for the slats.

An upper and lower spindle 1 at one end of the device is provided with a spur gear (not shown) for drive input from a motor, which is under the control of a control unit arranged to allow the motor to turn the spindles 1 through a 120° increment and then to halt for a predetermined interval before making the next 120° turn of the spindle 1.

I claim:

1. A display device comprising a plurality of rotary carriers mounted for rotation about respective axes which are parallel to each other, each of said carriers having mounted thereon, for rotation about respective second axes which are parallel to and equiangularly spaced about the said axis of rotation of the carrier, three supports each carrying means providing two elongate display faces which are disposed back to back and whose respective lengthwise axes are substantially coincident with the said second axis of rotation of the support, the arrangement of the carriers and supports being such that each display face on each carrier is capable of forming with a display face on each of the other carriers a substantially continuous display surface, motor means connected to rotate the carriers in rotational steps of 120° in unison to move each support on the carrier in turn into a position in which a display face thereof is in a display position, means associated with each carrier for rotating the support which is being moved out of said display position through 180° about said second axis during that 120° rotational step of the carrier, and means for oscillating each of the other two supports rotationally to and fro about their respective second axes during such 120° rotational step for providing a clearance between the longitudinal edges of the display faces on the support being rotated through 180° and the longitudinal edges of the display faces on the other two supports.

2. A display device as claimed in claim 1 wherein the rotational position of said supports is controlled by cam and follower means.

3. A display device comprising a plurality of rotary carriers mounted for rotation about respective axes which are parallel to each other, each of said carriers having mounted thereon, for rotation about respective second axes which are parallel to and equiangularly spaced about the said axis of rotation of the carrier, three supports each carrying means providing two elongate display faces which are disposed back to back and whose respective lengthwise axes are substantially coincident with the said second axis of rotation of the support, the arrangement of the carriers and supports being such that each display face on each carrier is capable of forming with a display face on each of the other carriers a substantially continuous display surface, motor means connected to rotate the carriers in unison in rotational step of 120° to move, in turn, each support on each carrier into a position in which a display ace thereof is in a display position, means associated with each carrier for rotating the support which is moving away from the display position through 180° about said second axis during that 120° rotational step of the carrier, and means for moving the other supports further from the first said axis during said 120° rotational step.

4. A display device comprising a plurality of rotary carriers mounted for rotation stepwise in unison about respective axes which are parallel to each other, each of said carriers having mounted thereon, for rotation about respective second axes which are parallel to and equiangularly spaced about the said axis of rotation of the carrier, a plurality of supports each carrying means providing two elongate display faces which are disposed back to back and the respective lengthwise axes of which are substantially coincident with the said second axis of rotation of the support, the arrangement of the carriers and supports being such that each display face on each carrier is capable of forming with a display face on each of the other carriers a substantially continuous display surface and means for progressively rotating the supports leaving the display position through 180° about their respective second axes, which progressive rotation commences simultaneously with the beginning of the rotational step of the carriers and ends simultaneously with the end of the rotational step of the carriers.

* * * * *